US006267029B1

(12) United States Patent
Hermann

(10) Patent No.: US 6,267,029 B1
(45) Date of Patent: Jul. 31, 2001

(54) CONSTRUCTION FOR AN ADJUSTABLE WRENCH

(75) Inventor: John A. Hermann, Colorado Springs, CO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/512,236

(22) Filed: Feb. 24, 2000

(51) Int. Cl.[7] ..... B25B 13/16
(52) U.S. Cl. ..... 81/170; 81/186
(58) Field of Search ..... 81/165, 170, 181, 81/186

(56) References Cited

U.S. PATENT DOCUMENTS

| | | | | |
|---|---|---|---|---|
| 591,743 | * | 10/1897 | Drew | 81/170 X |
| 3,948,120 | | 4/1976 | Hancock . | |
| 3,955,450 | | 5/1976 | Evans . | |
| 4,028,970 | | 6/1977 | Pelczar . | |
| 4,048,876 | | 9/1977 | Cagle . | |
| 4,706,528 | | 11/1987 | Inoue . | |
| 4,735,121 | | 4/1988 | Coulson . | |
| 4,766,786 | | 8/1988 | Jeremic . | |
| 4,831,903 | | 5/1989 | Dausey et al. . | |
| 5,022,290 | | 6/1991 | Duffy . | |
| 5,048,380 | | 9/1991 | Caldwell . | |
| 5,103,697 | | 4/1992 | Masbaum . | |
| 5,231,904 | | 8/1993 | Masbaum . | |
| 5,239,898 | | 8/1993 | Douglas . | |
| 5,806,383 | | 9/1998 | Hsieh . | |
| 5,809,852 | | 9/1998 | Haskell . | |

FOREIGN PATENT DOCUMENTS

| | | | | |
|---|---|---|---|---|
| 544950 | * | 4/1921 | (FR) | 81/170 |
| 20928 | * | of 1892 | (GB) | 81/170 |

* cited by examiner

*Primary Examiner*—James G. Smith
(74) *Attorney, Agent, or Firm*—Howrey Simon Arnold & White, LLP

(57) ABSTRACT

An improved design for an adjustable wrench and a method for making the same are disclosed. One embodiment of the disclosed wrench includes a main body which includes a handle, upper jaw, and an attachment portion such as a groove. The lower jaw of the wrench, which contains two ribs with threaded surfaces, is slipped over the attachment portion. The threaded surfaces of the ribs are made to meet with the threads on a thumbwheel, thus allowing the distance between the upper and lower jaws to be varied by turning the thumbwheel. Because the lower jaw slips over the attachment portion of the main body, the disclosed wrench can be manufactured with reduced expense. Moreover, this configuration provides for increased stability because the ribs of the lower jaw contact the thumbwheel at two points.

9 Claims, 4 Drawing Sheets

CONSTRUCTION FOR AN ADJUSTABLE WRENCH

FIELD OF THE INVENTION

The present invention relates in general to hand tools, and more specifically to an improved structure for an adjustable wrench and method for making the same.

BACKGROUND OF THE INVENTION

An example of typical adjustable wrench 10 found in the prior art is shown in FIGS. 1A and 1B. Wrench 10 is comprised of three main pieces, namely body 11 (which includes handle 12 and upper jaw 14), lower jaw 16, and thumbwheel 17. As one skilled in the art will immediately recognize, lower jaw 16 contains angled threads 18 which intermesh with similarly angled threads 20 on thumbwheel 17 in a screw-like fashion such that when thumbwheel 17 is rotated, lower jaw 16 will move to or from upper jaw 14 depending on the direction of rotation.

During manufacture, main body 11 is typically formed of hot forged steel. Then a bore hole 30 and slot 32 are formed in main body 11 to allow lower jaw 16 to be slid within. Bore hole 30 is formed by drilling a hole in the main body 11, usually straight through to the top of the handle. Then, slot 32 can be formed by a saw, usually a reciprocating broach bar. After bore hole 30 and slot 32 are formed, lower jaw 16 can be slid into place within main body 11. Thereafter, thumbwheel 17 is slipped into place so as to mesh threads 18 and 20 and is then permanently attached to main body 11 by a rivet 34.

The steps of forming bore hole 30 and slot 32 in the main body 11 add significant expense to the cost of manufacturing wrench 10. Moreover, the design of wrench 10 tends to rattle in the hand of the user when shaken. This is due to the fact that the lower jaw 16 is held steady within the bore hole 30 and slot 32 by its mechanical connection with thumbwheel 17. As shown in the cross-sectional view of FIG. 2, and due to the generally cylindrical shape of thumbwheel 17, thumbwheel 17 (or more specifically the threads 20 of the thumbwheel 17) comes into contact with the lower jaw 16 (or more specifically the threads 18 of lower jaw 16) at a single point. Because lower jaw 16 and thumbwheel 17 are not securely braced against one another, the lower jaw 16 will rattle in the user's hand when shaken back and forth in direction 25. This unsteadiness is perceived by prospective purchasers as being indicative of a wrench that is not constructed with good mechanical tolerances and hence is of poor quality.

The present invention solves these problems of the prior art by providing an improved design for an adjustable wrench which is less costly to manufacture and more stable in the user's hands.

SUMMARY OF THE INVENTION

The present invention comprises an improved design for an adjustable wrench and a method for making the same. In accordance with one exemplary embodiment, the inventive wrench includes a main body which includes a handle, upper jaw, and an attachment portion such as a groove or tab. The lower jaw of such wrench, which contains two ribs with threaded surfaces, is slipped over the attachment portion. The threaded surfaces of the ribs are made to meet with the threads on a thumbwheel, thus allowing the distance between the upper and lower jaws to be varied by turning the thumbwheel. Because the lower jaw slips over the attachment portion of the main body, such a wrench can be manufactured with reduced expense. Moreover, this configuration provides for increased stability because the ribs of the lower jaw contact the thumbwheel at two points. This configuration also allows the lower jaw to be easily removed and replaced.

BRIEF DESCRIPTION OF THE DRAWINGS

The foregoing and other advantages of the invention will become apparent upon reading the following detailed description and upon reference to the drawings in which.

DESCRIPTION OF ILLUSTRATIVE EMBODIMENTS

Figure 1A:
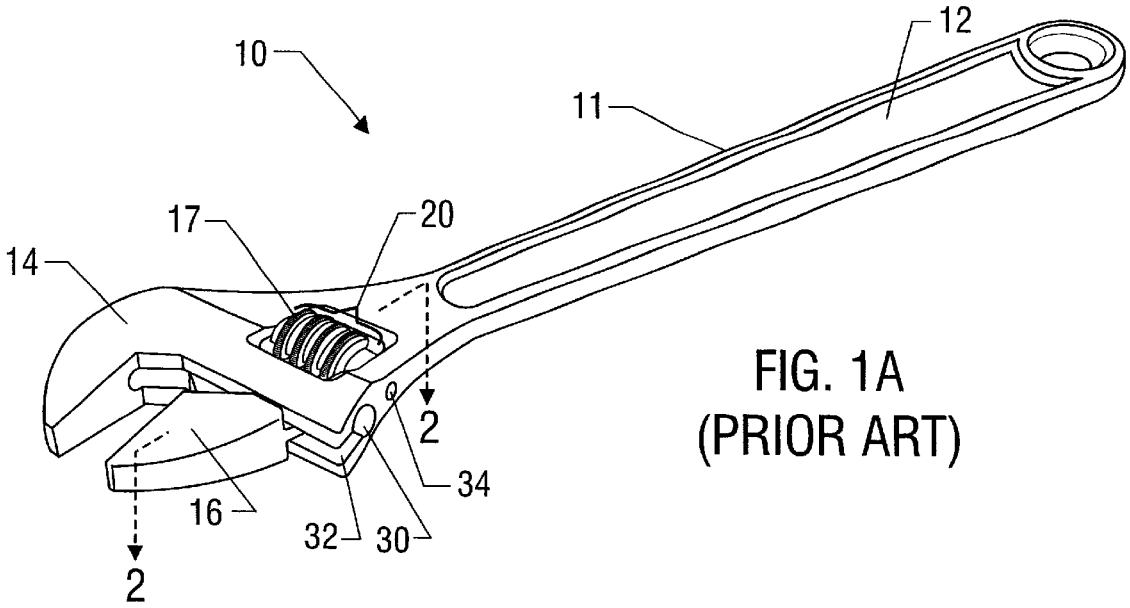
FIG. 1A (PRIOR ART)
FIG. 1A shows a prior art adjustable wrench.
Figure 1B:
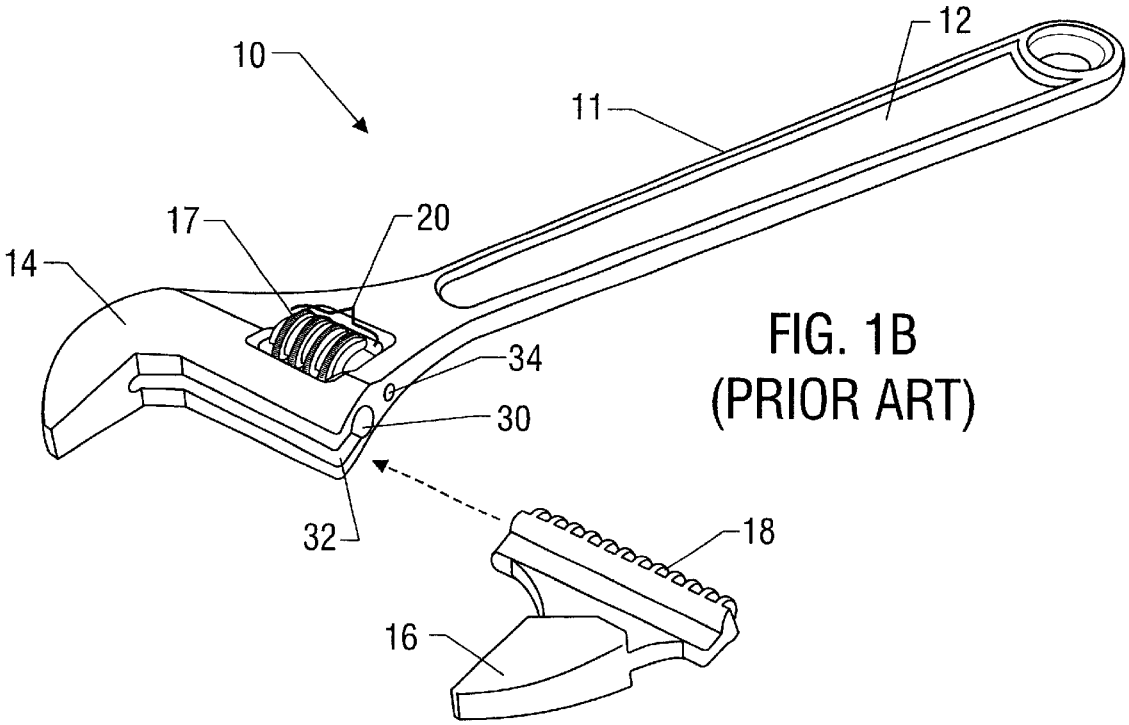
FIG. 1B (PRIOR ART)
FIG. 1B shows the prior art wrench of FIG. 1A with the lower jaw removed for clarity.
Figure 4:
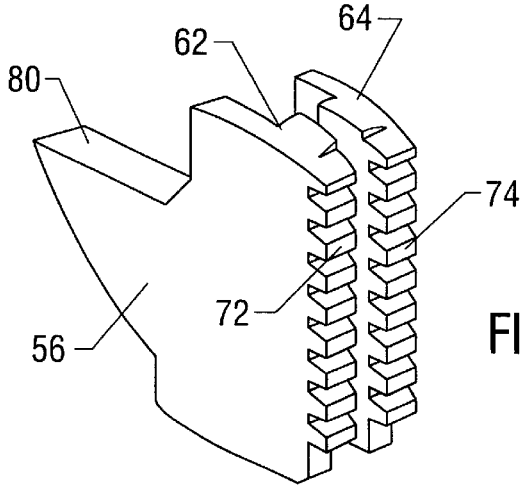
FIG. 4 shows the lower jaw of the wrench of FIG. 3A.
Figure 3A:
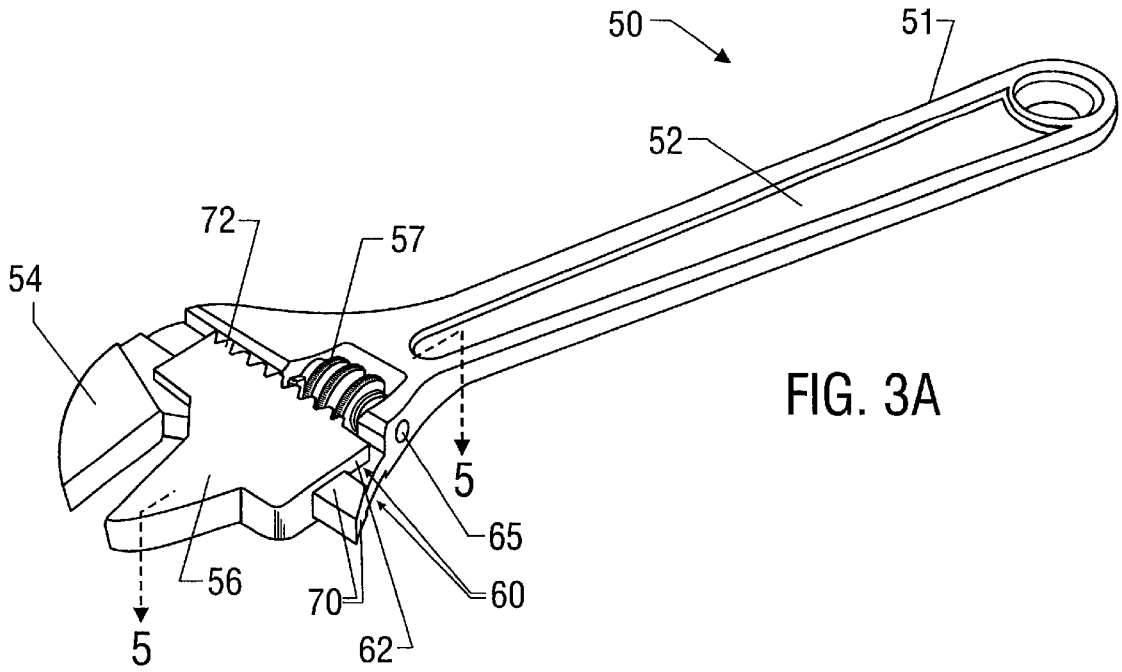
FIG. 3A shows an exemplary embodiment of a wrench constructed in accordance with the teaching provided herein.
Figure 3B:
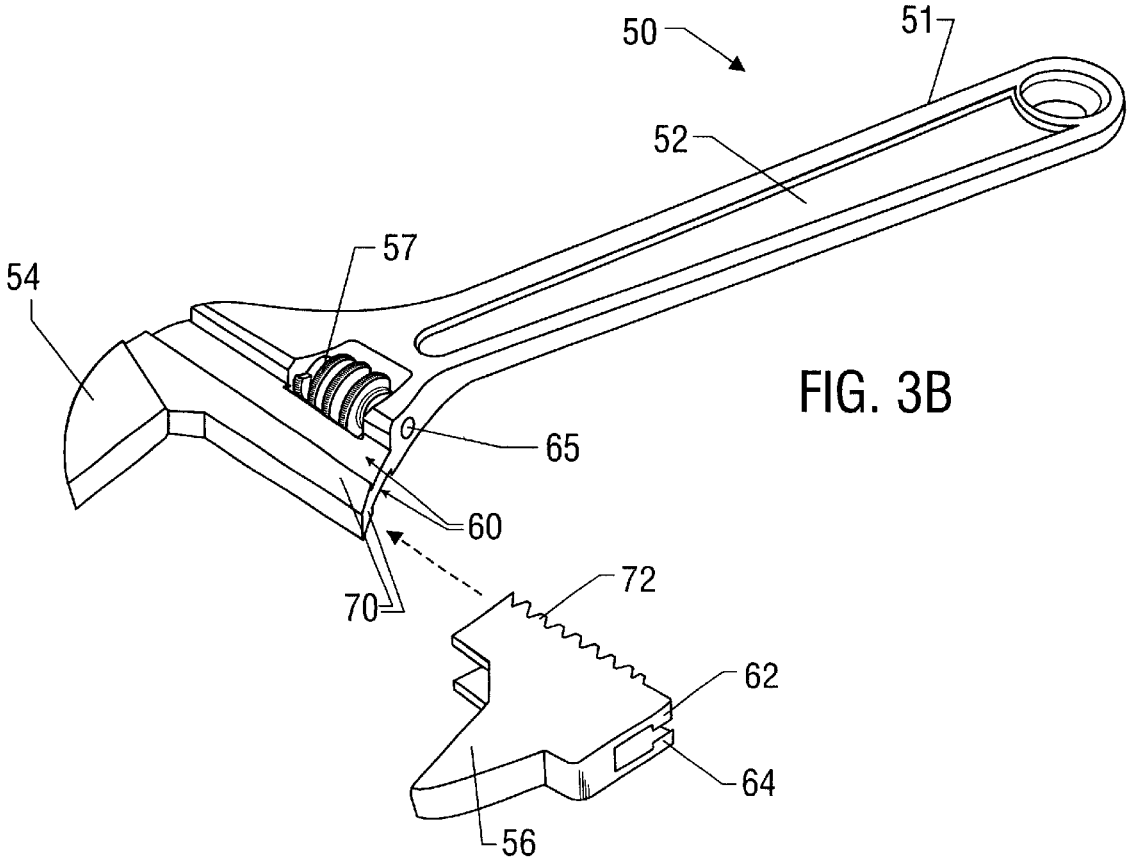
FIG. 3B shows the wrench of FIG. 3A with the lower jaw removed for clarity.

FIGS. 3A and 3B show the preferred embodiment of a wrench 50 constructed in accordance with the present invention. Like the prior art adjustable wrench of FIG. 1, wrench 50 is comprised of three main pieces: main body 51 (which includes handle 52 and upper jaw 54), lower jaw 56, and thumbwheel 57. However, main body 51 does not contain a bore hole or slot. Instead, the main body 51 is formed to contain an attachment portion, which in this embodiment constitutes groove 60. Groove 60 and is preferably formed into both the front and back of main body 51 as shown in FIGS. 3A and 3B. The lower jaw 56, which is shown in more detail in FIG. 4 and which contains two ribs 62 and 64 with threaded surfaces 72 and 74, slides over groove 60 during the manufacture of wrench 50. Then thumbwheel 57, complete with threads 58, is positioned into place as in the prior art, and fastened to the main body 51 by rivet 65. Thus, the lower jaw 56 is secured to the main body 51 by the use of groove 60 and by the intermeshing of the threads 72 and 74 of ribs 62 and 64 and threads 58 of thumbwheel 57.

Alternatively, and preferably, groove 60 may be milled to produce a more planar surface that will meet with lower jaw 56 with a more precise tolerance. Regardless of whether the groove 60 is milled or not, the end result is a wrench which is less expensive to manufacture because it need not be drilled or sawn to form the bore hole or slot of the prior art.

Wrench 50 otherwise operates like the wrench of the prior art. When the user turns the thumbwheel 57, the ribs 62 and 64 will slide over groove 60 to vary the distance between the contact surfaces 80 of the upper and lower jaws 54 and 56. This results from the screw relationship established between angled threads 62 and 64 of the lower jaw and angled threads 58 of thumbwheel 57.

Figure 2:
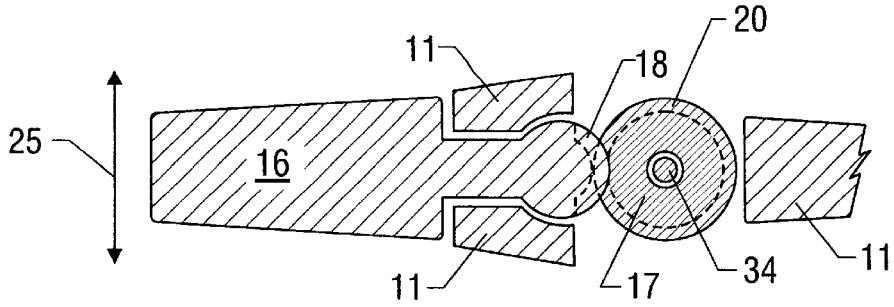
FIG. 2 (PRIOR ART)
FIG. 2 shows a cross-section of the prior art wrench and shows the single point of contact between the threads of the lower jaw and the threads of the thumbwheel.
Figure 5:
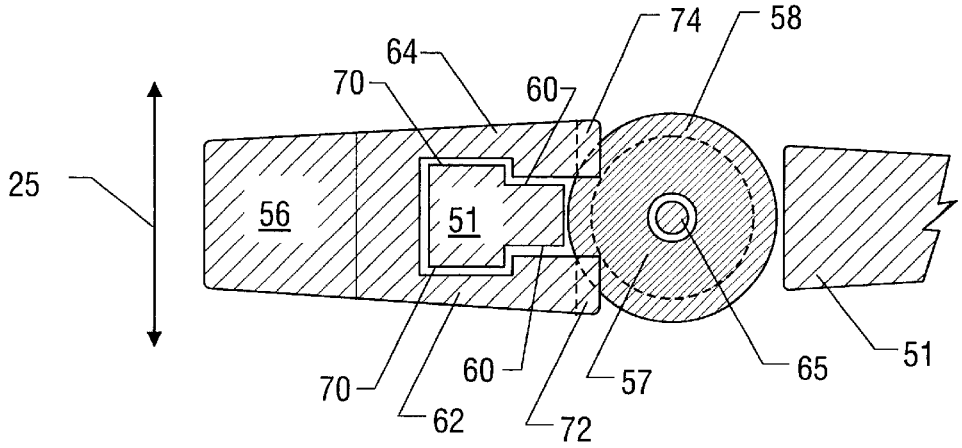
FIG. 5 shows a cross-section of the wrench of FIG. 3A and shows the points of contact between the threads of the lower jaw and the threads of the thumbwheel.

This design also has performance advantages. As previously noted with respect to FIG. 2, wrench 10 of the prior art has a single point of contact between lower jaw 16 and thumbwheel 17, a configuration that allows the wrench 10 to rattle when shaken. However, in the inventive wrench 50, because the lower jaw 56 contains two ribs 62 and 64 that span the thumbwheel 57, the thumbwheel 57 will touch both ribs, as shown in cross-section in FIG. 5. The result is that thumbwheel 57 and lower jaw 56 are stabilized with respect to one another. (As in the prior art, it is actually the threads 58 of the thumbwheel 57 and the threads 72 and 74 of the lower jaw 56 that come into contact). The result is a wrench that is less prone to rattling when shaken and which therefore feels more solid in the user's hand. Such a wrench should enjoy increased marketability as it will be perceived by purchasers as being of high quality.

Figure 6:
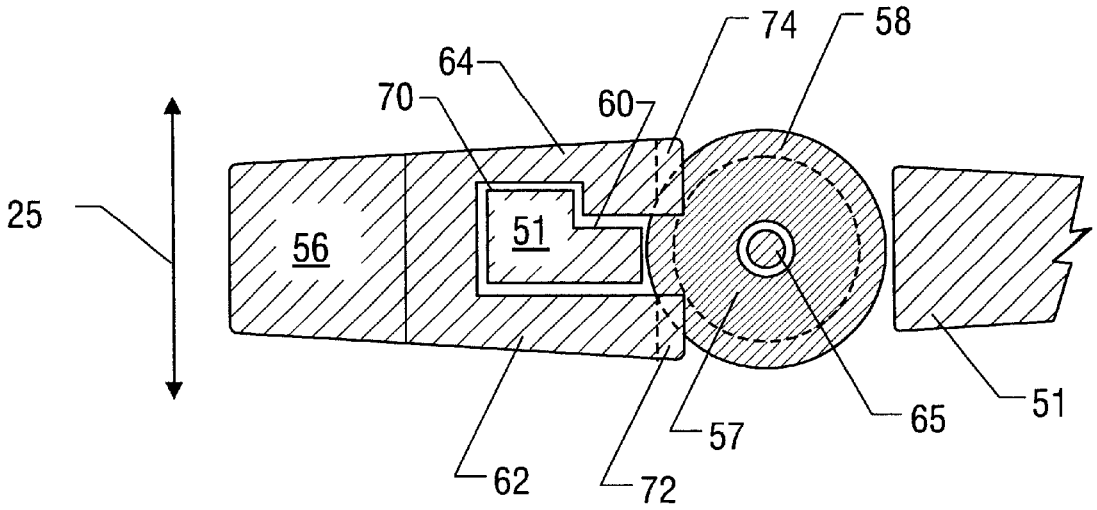
FIG. 6 shows a cross-section of another exemplary embodiment of a wrench constructed in accordance with the teaching provided herein.
Figure 7:
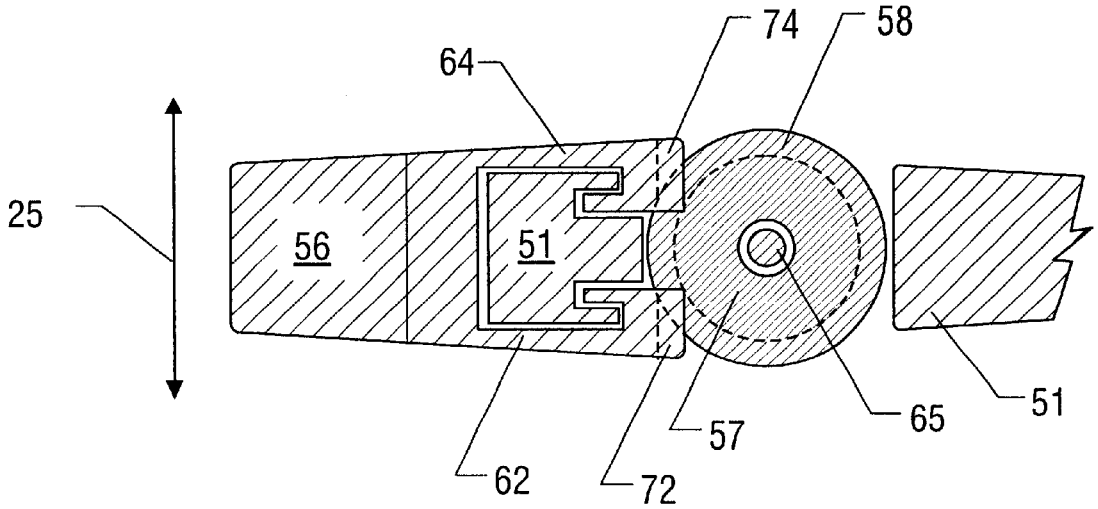
FIG. 7 shows a cross-section of yet another exemplary embodiment of a wrench constructed in accordance with the teaching provided herein.

Other embodiments of the present invention achieve the same benefits as the embodiment disclosed in FIGS. 3A–5. For example, the lower jaw 56 can be made to slide over and fit with a variety of other attachment portions on main body 51 other than the groove 60. For example, various forms of tabs or other structures could be fabricated as the attachment portions on main body 51. (The groove 60 in the disclosed preferred embodiment in effect defines one embodiment of a tab 70. See FIGS. 3A and 3B.) A lower jaw could be constructed which would mate with and slide over these tabs, just as lower jaw 56 is made to mate with and slide over groove 60. Moreover, these tabs need not appear on the edge of the main body 51 that faces the lower jaw 56; instead, a tab 70 could be formed on the side of the main body, as shown in FIG. 6. Of course, many other structures could be fabricated on main body 51 which could be made to slip inside of a suitably shaped lower jaw, such tab 82 shown in FIG. 7. However, the fabrication of such a tab 82, while resulting in a device with increased stability in the user's hand due to the dual point contact between the lower jaw and the thumbwheel, might be unnecessarily expensive to fabricate. Still, such an embodiment, while not presently preferred, would still come within the spirit of the invention.

The disclosed wrench is also beneficial in that, after manufacture, lower jaw 56 can be easily removed and replaced by unscrewing it free from main body 51. This functionality is useful if the lower jaw breaks, or if for certain applications it is desired to use a lower jaw with different properties. For example, a substitute lower jaw 56 could have a contact surface 80 with a serrated surface suitable for grabbing a pipe or other structures. Another lower jaw 56 could have a contact surface 80 with a V-groove or other recess formed therein for restraining angular structures such as hexagonal nuts. Yet another lower jaw 56 could have a contact surface 80 that includes a bladed edge that might be useful in cutting pipes or other structures restrained between the upper and lower jaws 54 and 56. These alternative lower jaw structures can be slipped over groove 60 and tabbed edge 70 and easily screwed on and off using thumbwheel 57.

What is claimed is:

1. An adjustable wrench, comprising:

a main body, the main body including a handle, a first jaw, and an attachment portion;

a second jaw, wherein the second jaw slides over the attachment portion of the main body, and wherein the second jaw contains two parallel threads facing the same direction; and a threaded thumbwheel mounted to the main body, wherein the two threads and the threaded thumbwheel are in contact such that rotation of the thumbwheel causes the second jaw to move with respect to the first jaw.

2. The adjustable wrench of claim 1, wherein the attachment portion is a groove.

3. The adjustable wrench of claim 1, wherein the attachment portion is a tab.

4. The adjustable wrench of claim 1, wherein the second jaw is removable from the main body.

5. The adjustable wrench of claim 1, wherein the second jaw contains a bladed edge.

6. The adjustable wrench of claim 1, wherein the second jaw contains a grooved contact surface.

7. The adjustable wrench of claim 1, wherein the second jaw contains a contact surface with a recess therein to restrain an object between the first and second jaws.

8. The adjustable wrench of claim 1, wherein the second jaw includes two ribs in slidable relation with the attachment portion.

9. The adjustable wrench of claim 8, wherein the two ribs are coupled to the two threads.

* * * * *